US005247925A

United States Patent [19]

Yamasaki et al.

[11] Patent Number: 5,247,925

[45] Date of Patent: Sep. 28, 1993

[54] CHAIR FOR OFFICE WORK WITH VIBRATION STRUCTURE

[75] Inventors: Yoshikiyo Yamasaki, Sakai; Shinichiro Fujimoto, Osaka, both of Japan

[73] Assignees: Kabushiki Kaisha Japan Health, Sakai; Kabushiki Kaisha Fuji Iryoki, Osaka, both of Japan

[21] Appl. No.: 813,132

[22] Filed: Dec. 23, 1991

[51] Int. Cl.[5] ..... A61H 1/00

[52] U.S. Cl. ..... 128/33; 128/36

[58] Field of Search ..... 128/32, 33, 36, 41, 128/34, 35

[56] References Cited

U.S. PATENT DOCUMENTS

| | | | |
|---|---|---|---|
| 2,937,641 | 5/1960 | Oetinger | 128/33 |
| 3,048,168 | 8/1962 | Kamp | 128/33 |
| 3,068,858 | 12/1962 | Suarez | 128/41 |
| 3,194,522 | 7/1965 | Azneer | 128/33 |
| 3,446,204 | 5/1969 | Murphy | 128/33 |
| 3,831,591 | 8/1974 | Newkirk | 128/36 |
| 4,635,287 | 1/1987 | Hirano | 128/33 |
| 5,022,384 | 6/1991 | Freels | 128/36 |
| 5,113,851 | 5/1992 | Gamba | 128/33 |

*Primary Examiner*—Robert A. Hafer
*Assistant Examiner*—David J. Kenealy
*Attorney, Agent, or Firm*—Flynn, Thiel, Boutell & Tanis

[57] ABSTRACT

The body of a vibration transmission device is equipped in the seat and the back of a chair for office work to provide a vibration massage of wide range to the hip, thigh, and spine of the user. The vibration body has U-shape wire rods around a plate and is equipped in at least one of the seat and the seat back of the chair.

2 Claims, 6 Drawing Sheets

CHAIR FOR OFFICE WORK WITH VIBRATION STRUCTURE

FIELD OF THE INVENTION

This invention relates to an office-type chair for use in an office or a home. More particularly, this invention relates to an office-type chair equipped with a vibration structure constructed to provide proper vibration massage on the user's back or thighs and so on in order to relax the user's body.

DESCRIPTION OF THE PRIOR ART

Conventional office-type chairs, for example, as shown in FIG. 9, have a pedestal-type base in which several branch legs extend radially from the lower end of a vertical support column. Casters are provided on the branch legs. A seat assembly is supported for rotation and for height adjustment above the support column. Armrests may be provided on opposite sides of the seat. A seat back assembly is elastically connected to the rear end of the seat assembly so that it can be inclined to be at a selected angle with respect to the seat.

There is no problem in normal use of the conventional office-type chair. However, when the user works in a seated position for many hours, it is hard on the hips, back and spine of the user. Especially, it is painful to do concentrated work on a computer, word processor or the like in a fixed posture for many hours. Fatigue from physical or mental stress interferes with the user's work.

Recently, therefore, products which can provide relaxation for the body of an office worker, during a break, have been desired. However, products which comply with the request have not yet been developed.

SUMMARY OF THE INVENTION

It is an object of this invention to provide an office-type chair provided with a vibration structure. The chair provides proper massage on at least one of the hips, thighs and back of a user who is sitting on the seat by equipping a vibration transmitting assembly which can transmit vibration to a wide area, in at least one of the seat and the seat back. The seat is supported for swivelling and for height adjustment above a support column. The seat back is inclined at a selected angle at the rear end of the seat. The seat and seat back are elastically mounted so that they can be tilted rearwardly as a unit relative to the base. The chair provides a massaging action on the body of an office worker who uses the chair, and it reduces fatigue caused by physical and mental stress.

It is a further object of this invention to provide an office-type chair equipped with a vibration structure which can impart strong vibration massage on the hips, thighs and back of the user caused by the user sitting deeply and putting weight on the seat back so that the vibration transmission assembly of the seat is projected upwardly whereby to reduce the physical fatigue and mental stress of the user.

It is a further object of this invention to provide an office-type chair equipped with a vibration structure which can impart strong vibration massage on the back of a user caused by the user sitting and putting weight on the armrests with the user's arms so that the vibration transmission assembly of the seat back is projected forwardly, whereby to reduce the physical fatigue and mental stress of the user.

The office-type chair provided with a vibration structure, according to this invention, has a seat which is supported for rotation and for height adjustment above the support column. The seat back is elastically connected to incline at a selected angle to the rear of the seat. In the chair, the vibration transmitting assembly is constructed of U-shaped wire rods extending radially from the upper plate of the vibrator body. The vibration transmitting assembly is provided in at least one of the seat and the seat back. The vibrator and U-shaped wire rods are vibrated by externally supplied electric power. Vibration can be transmitted to wide areas of the seat and the seat back of the chair. The chair has a seat which is supported for rotation and for height adjustment above the support column. The seat back is elastically connected to incline at a selected angle to the rear of the seat.

In another embodiment of the chair, a vibration transmitting assembly is installed in each of the seat and the seat back. The two vibrators of vibration transmitting assemblies are installed on the connection plate which is bent at the middle, and it is L-shaped in side view. The connection plate is installed at the middle of the seat and seat back. When the user puts weight on the seat back, the vibration transmitting assembly of the seat is projected upwardly, and it can transmit vibration to the seat strongly. The chair has a seat which is supported for rotation and for height adjustment above the support column. A pair of armrests is provided on opposite lateral sides of the seat. The seat back is elastically connected to incline at a selected angle to the rear of the seat.

In yet another embodiment of the chair, the armrests can move upwardly or downwardly. A bonding plate is installed in the seat at the middle of and extending between both lower ends of the armrests. One vibration transmitting assembly is installed on the bonding plate in the seat, and another vibration transmitting assembly is installed in the seat back. The two vibration transmitting assemblies are connected to the connection plate which is bent at the middle, and it is L-shaped in side view. The connection plate is installed at the middle of the chair. When the user puts weight on the armrests, it makes the vibration transmitting assembly of the seat back project ahead whereby it can transmit vibration to the seat back strongly.

The office-type chair of this invention works as follows. The vibration transmitting assembly has U-shaped wire rods at a certain spacing around the upper plate of the vibrator. The vibration transmitting assembly is installed in at least one of the seat and the seat back of the chair. Therefore, the vibrator can vibrate the vibration body and the U-shaped wire rods externally by supplied electric power. Vibration massage can be applied to wide areas of the seat and the seat back of the chair.

In this invention, a vibration transmitting assembly is installed in each of the seat and the seat back. The two vibration transmitting assemblies are connected to a connection plate which is bent at the middle, it is L-shaped in side view, and it is installed at the middle of the chair. When the user puts weight on the seat back, the vibration transmitting assembly in the seat is projected upwardly and applies strong vibration on the hips and thighs of the user.

In this invention, the armrests can move upwardly and downwardly, the bonding plate is installed at the middle and extending between the lower ends of the armrests, a vibration transmitting assembly is installed on the bonding plate in the seat, and a vibration transmitting assembly is installed in the seat back, the bodies of vibration transmission are connected to the connection plate which is bent at the middle, it is L-shaped in side view, and it is installed in the middle of the chair. By putting the user's weight on the armrests, the vibration transmitting assembly is projected upwardly, the vibration transmitting assembly is put on the user's back effectively and it gives strong vibration massage to the user's whole back.

DESCRIPTION OF THE PREFERRED EMBODIMENT

Figure 1:
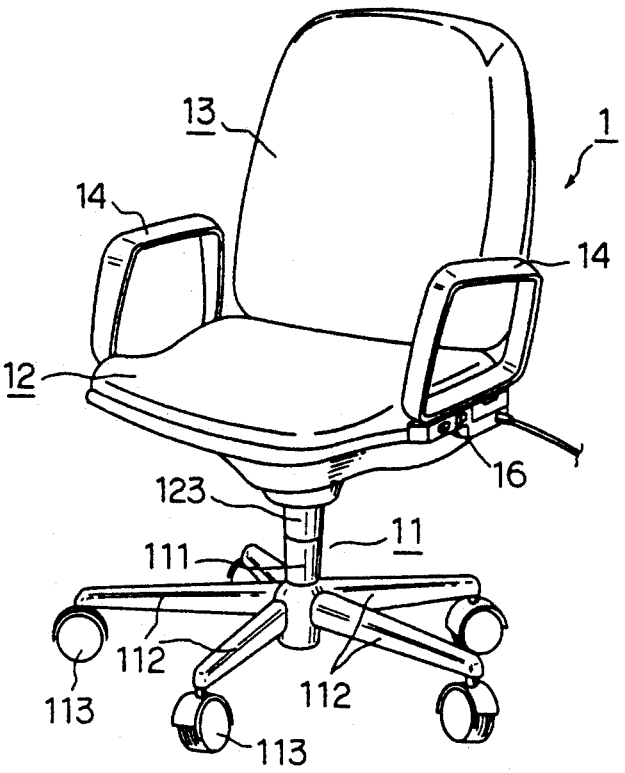
FIG. 1 is a perspective view of an embodiment of this invention.

In FIG. 1 to FIG. 4, there is shown an embodiment of an office-type chair 1 provided with a vibration structure, according to this invention.

The chair 1 comprises a vibration transmitting assembly 15 which assembly is mounted in at least one of the seat 12 and the back 13 of the office-type chair 1.

The seat 12 is supported for rotation about a vertical axis and for vertical height adjustment above the vertical support column or pedestal 11.

The chair back 13 is elastically connected so that it is inclined at a selected angle relative to the rear of the seat 12.

The vibration transmitting assembly 15 can be vibrated by electric power supplied from an external electric power source.

Figure 2:
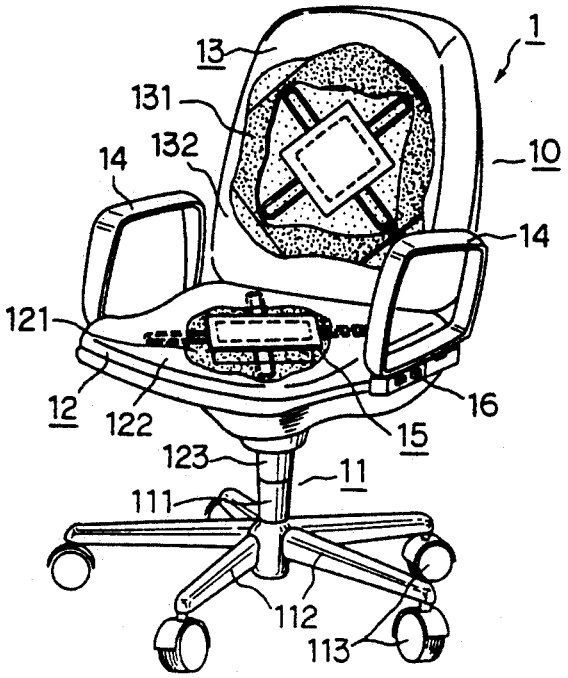
FIG. 2 is an explanatory view of the first embodiment of this invention.

The office-type chair 1 comprises a support column or pedestal 11, a seat 12, a chair back 13 and armrests 14, as shown in FIG. 1 and FIG. 2.

The support column 11 comprises a support cylinder 111. A support post 123 extends downwardly from the center of the seat 12 and is inserted into the support cylinder 111 to support the seat 12 at the proper height.

The support legs 112 extend radially outwardly from the lower end of the support column 11. A caster 113 is mounted on the outer end of each support leg 112 so that the chair 1 is rollably supported by the casters 113. The support cylinder 111 and support legs 112 define a chair base.

The seat 12 is comprised of an elastic cushion 121 covered with an upholstery material 122. The elastic cushion 121 is substantially square, has a selected thickness and is, for example, made of polyurethane and which has resiliency. The upholstery material 122 covers the elastic cushion 121.

The support post 123 is supported with bearings below the seat 12 and is inserted into the support leg 11 for adjustment of its height, and it supports the seat 12 for rotation about a vertical axis.

The seat back 13 is comprised of an elastic cushion 131 and an upholstery material 132, like the seat 12. The elastic cushion 131 is square, has a certain thickness and is made, for example, of polyurethane and which has resiliency. The upholstery material 132 cover the elastic cushion 131. The seat back 13 is attached elastically adjacent to the rear of the seat 12 so that it is inclined at a selected angle.

The armrests 14 are made of plastic or metal and they can be of hollow frame shape or plate shape. The armrests 14 are provided on opposite lateral sides of the seat. The armrests 14 are provided in order to keep the upper half of the user's body in a relaxed condition, with the user's arms resting on the upper sides of armrests 14.

Figure 3:
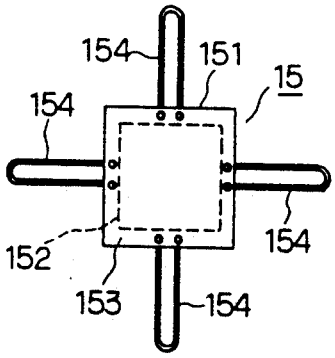
FIG. 3 is a plan view of an embodiment of the vibration transmitting assembly of this invention.
Figure 4:
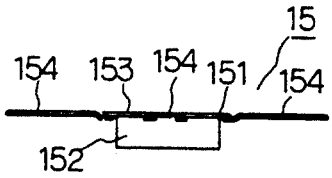
FIG. 4 is a side view of an embodiment of the vibration transmitting assembly of this invention.

The vibration transmitting assembly 15 is installed in at least one of the seat 12 and the seat back 13 of the chair 1. The vibration transmitting assembly 15 is, for example, as shown in FIG. 3 and FIG. 4, comprised of a vibrator body 151 which is vibrated by a vibration structure (not shown), such as an electro-magnet or an eccentric sash weight mounted at the end of the shaft of a motor in the square case 152. Radially outwardly extending U-shaped wire rods 154 are connected at equally spaced intervals around the perimeter of the upper plate 153 of the vibrator body 151 (four wire rods 154 are equipped in the embodiment illustrated in the drawings). Each of the wire rods 154 is comprised of two parallel legs whose inner ends are fixed to the upper plate 153 and the outer ends of the legs are connected to each other by a reversely curved bight portion. The assembly 15 is connected to the external electric source of A.C. or D.C. (not shown). The supplied electric power vibrates the vibrator body 151 and the U-shaped wire rods 154 connected to the vibrator body 151. Vibrations can be transmitted to wide areas of the seat 12 and the seat back 13 of the chair 1. The U-shaped wire rods 154 extend radially from the upper plate 153 of the vibrator body 151 and, therefore, the structure is stable and the resiliency is increased.

When the user uses the chair 1 constructed as described above, the user sits on the seat 12 in normal posture. When the user desires to be massaged, the user only needs to switch on the switch 16. The vibrator body 151 is thereby vibrated by the electric power supplied from the external electric source, and the U-shaped wire rods 154 connected to the vibrator body 151 are also vibrated. They give a proper massage by applying vibration on at least one of the hips, thighs and back of the user sitting on the seat 12, whereby it relaxes the user who is sitting on the chair 1, and it reduces fatigue from physical and mental stress.

Figure 5:
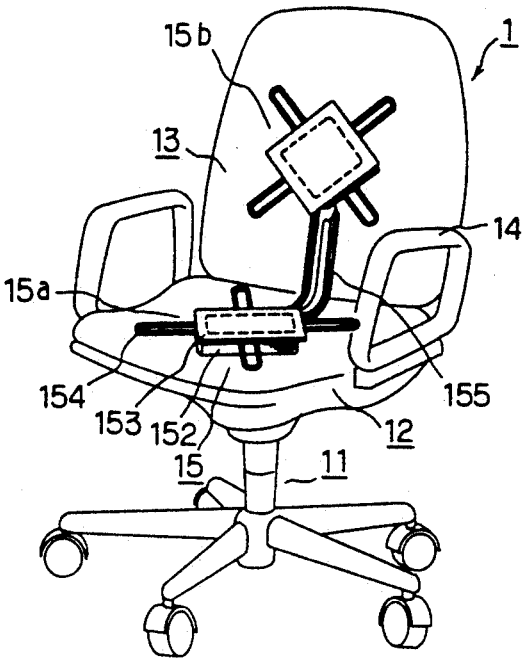
FIG. 5 is an explanatory view of the second embodiment of this invention.

FIG. 5 shows the second embodiment of the office-type chair 1 with vibration structure, according to this invention.

In the chair 1, the vibration transmitting assembly 15 is provided in each of the seat 12 and the seat back 13 of the chair 1. By putting the weight of the user's back on the seat back 13, the vibration transmitting assembly 15 of the seat 12 is projected upwardly so that it can transmit vibrations strongly to the hips and thighs of the user sitting on the seat 12. The vibration transmitting assembly 15 is comprised of the assembly 15*a* in the seat 12 and the assembly 15*b* which is provided in the seat back 13.

A connection member 155, which is L-shaped in side view and is bent at the middle at the same angle as the angle that is formed by the seat 12 and the seat back 13, is provided between the vibration transmitting assemblies 15*a* and 15*b*. The middle of the connection plate 155 is provided at the juncture of the seat 12 and the seat back 13.

Figure 7:
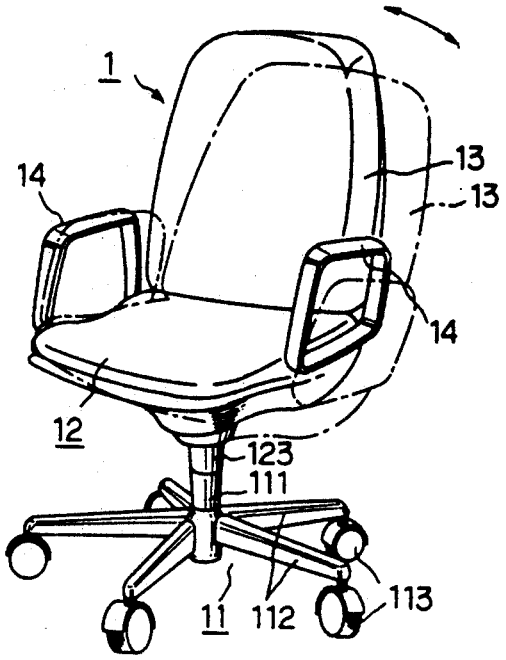
FIG. 7 is an explanatory view of the second embodiment of this invention in use.

When the user uses the chair 1 constructed as described above for the second embodiment of this invention, if the user wants to be massaged, the user switches on the switch 16, and puts the user's weight on the seat back 13 as shown in FIG. 7, the vibration transmitting assembly 15*b* is pressed backwardly and the end of the connection plate 155 in the seat 12 is moved upwardly, with the bent part being the supporting point. The vibration transmitting assembly 15*a* in the seat 12 is projected upwardly. The strong massage applied to the user's back and the strong vibration transmission to the hips and thighs by the vibration transmitting assembly 15*a* which is connected to the plate 155 can be made at the same time.

Figure 6:
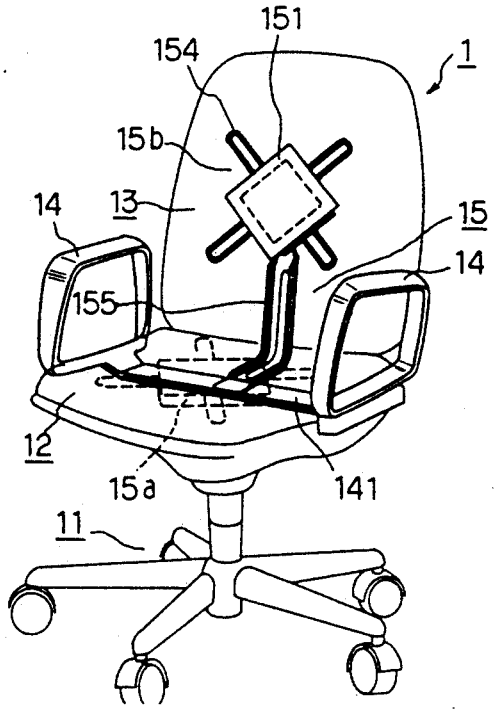
FIG. 6 is an explanatory view of the third embodiment of this invention.

FIG. 6 shows the third embodiment of the office-type chair 1 of this invention.

The chair 1 has armrests 14, 14, which can move upwardly and downwardly on both lateral sides of the seat 12. A bonding plate 141 is provided in the seat 12 at the middle of and extending laterally between the armrests 14, 14 of the chair 1. The vibration transmitting assembly 15 is connected to each of the seat 12 and the seat back 13 on the bonding plate 141.

By putting the user's arms on the armrests 14, 14, the body of the vibration transmitting assembly 15*b* of the seat back 13 is projected ahead, and it can apply strong vibration transmission to the user's back. The vibration transmitting assembly 15 is fixed on the bonding plate 141 and it is comprised of a vibration transmitting assembly 15*a* for the seat 12 and the vibration transmitting assembly 15*b* for the seat back 13.

The connection plate 155 is L-shaped in side view and is bent at the same angle as the angle formed by the seat 12 and the seat back 13. The middle of the connection plate 15 is fixed at the juncture of the seat 12 and the seat back 13.

Figure 8:
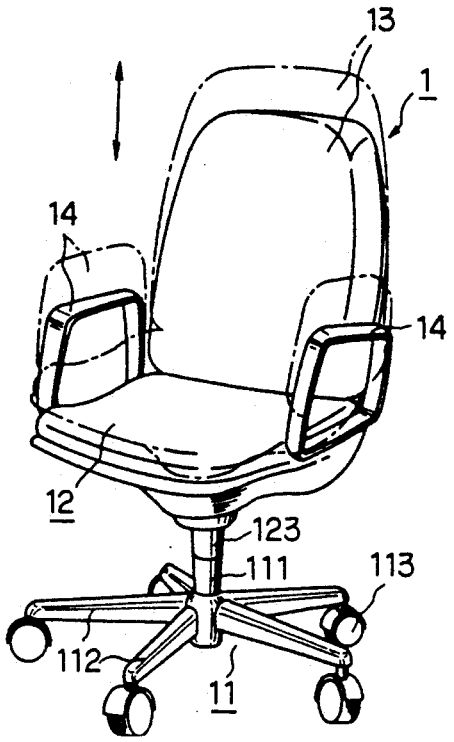
FIG. 8 is an explanatory view of the third embodiment of this invention in use.
Figure 9:
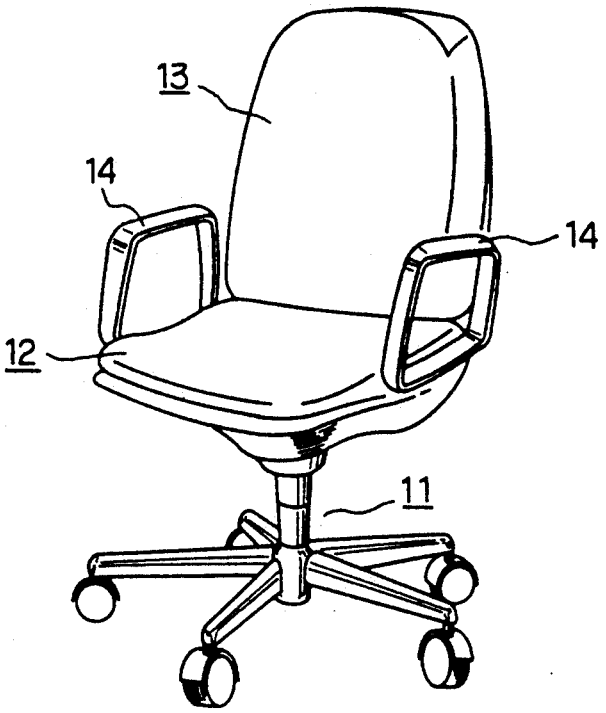
FIG. 9 PRIOR ART
FIGS. 9, 10 and 11 are perspective views of a conventional office-type chair.
Figure 10:
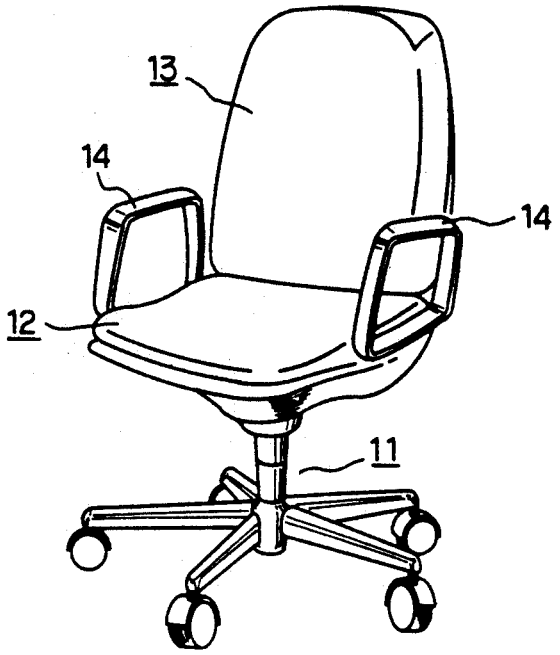
Figure 11:
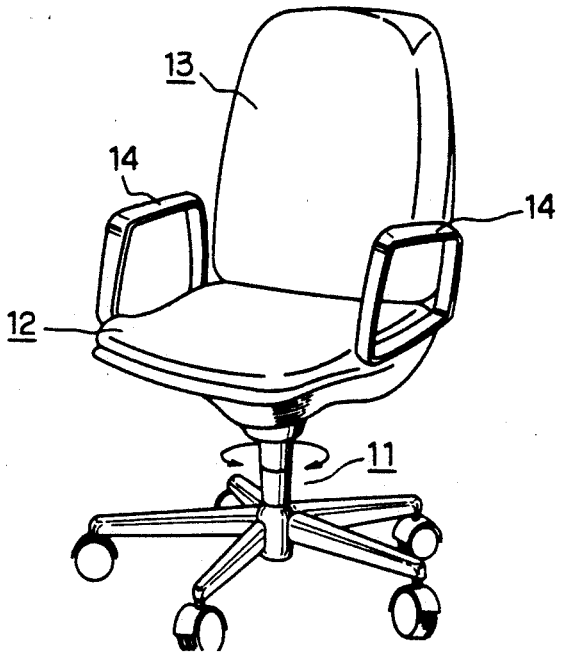

When the user uses the chair 1 constructed as described above for the third embodiment of this invention, if the user wants to be massaged, the user switches on the external electric source, and the user's arms are put on the armrests 14, as shown in FIG. 8, the weight of the upper half of the body is placed on the seat, the vibration transmitting assembly 15*a* on the bonding plate 141 is pressed downwardly, the end of the connection plate 155 in the seat back is moved forwardly, with the bent part being the supporting point, and the body of the vibration transmitting assembly 15*b* of the seat back 13 connected to the upper end of the connection plate 155 is projected ahead.

The strong massage of the hips and thighs caused by putting the user's weight on the seat 12 and the strong vibration transmission to the back by the vibration transmitting assembly 15*b* can be made at the same time.

The chair for office work with vibration structure of this invention has the vibration transmitting assembly which can transmit vibrations to a wide area of the chair for at least one of the seat and the seat back.

The seat is supported for pivoting movement and to adjust its height above the support column. The seat back 13 is elastically connected at the rear of the seat 12 and is inclined at a certain angle. Proper massage can be applied on at least one of the hips, thighs and back of a user sitting on the seat.

It is different from the conventional chair for office work because it can reduce the burden applied to hips, thighs, back and spine of an office worker who sits at a certain posture for many hours, especially an office worker doing concentrated work on a computer or word processor, it reduces the fatigue caused by physical and mental stress, and it provides physical and mental rest. Therefore, it is useful for health purposes.

In this invention, the vibration transmitting assembly which is provided in each of the seat and the seat back has U-shaped wire rods spaced apart at certain intervals and connected radially around the upper plate of the vibration body. Therefore, it is different from the conventional vibrator because not only the vibration body, but also the U-shaped wire rods are vibrated by supplied electric power from an external source, it can transmit vibrations to wide areas of the seat and the seat back of the office-type chair.

Accordingly, this invention solves problems encountered with conventional office-type chairs and gives rest and various massage effects to the user.

We claim:

1. A chair, comprising:

a chair base;

a vertical pedestal projecting upwardly from the central region of said chair base;

a substantially horizontal chair seat mounted on the upper end of said pedestal for swivelling movement about a vertical central axis of said pedestal and for vertical height adjustment relative to said chair base, said chair seat comprising a first elastic cushion for supporting the hips of a user;

an upright chair back extending upwardly from said chair seat adjacent to a rear edge thereof, said chair back comprising a second elastic cushion for supporting the back of a user;

a generally planar, vibration transmitting assembly disposed in each of said first and second cushions, said assembly being comprised of a vibrator located in the central region of each of said cushions and a plurality of elongated, spaced-apart, wire rods which are U-shaped in plan view, said wire rods having inner longitudinal ends which are fixed to said vibrator, said wire rods radiating outwardly from said vibrator around the perimeter thereof with the outer longitudinal ends of said wire rods being free to vibrate in response to vibrations of said vibrator, said assembly extending substantially parallel with the surface of said cushion which the user's body is adapted to contact, the outer ends of said wire rods extending close to but terminating short of the perimeter of each of said cushions whereby vibrations of said vibrators are applied to a wide area of each of said cushions, the vibrators of said vibration transmitting assemblies being fixedly connected together by an L-shaped connection plate comprising a horizontal leg disposed in said first cushion and an upright leg disposed in said second cushion so that when a user puts one's weight on said chair back, it causes the vibration transmitting assembly of said chair seat to project upwardly to transmit a strong vibration to said chair seat.

2. A chair, comprising:

a chair base;

a vertical pedestal projecting upwardly from the central region of said chair base;

a substantially horizontal chair seat mounted on the upper end of said pedestal for swivelling movement about a vertical central axis of said pedestal and for vertical height adjustment relative to said chair base, said chair seat comprising a first elastic cushion for supporting the hips of a user;

an upright chair back extending upwardly from said chair seat adjacent to a rear edge thereof, said chair back comprising a second elastic cushion for supporting the back of a user;

a pair of armrests located on opposite sides of said chair seat, said armrests being movable upwardly or downwardly relative to the chair base and including a horizontal bonding plate installed in said chair seat at the middle of and connected between the lower ends of said armrests;

a generally planar, vibration transmitting assembly comprising a vibrator installed in a central region of said chair seat and mounted on said bonding plate and a second vibration transmitting assembly comprising a vibrator installed in a central region of said chair back, each of said vibration transmitting assemblies comprising a plurality of elongated, spaced-apart, wire rods which are U-shaped in plan view, said wire rods having inner longitudinal ends which are fixed to said vibrator, said wire rods radiating outwardly from said vibrator around the perimeter thereof with the outer longitudinal ends of said wire rods being free to vibrate in response to vibrations of said vibrator, said assembly extending substantially parallel with the surface of said cushion which the user's body is adapted to contact, the outer ends of said wire rods extending close to but terminating short of the perimeter of said one cushion whereby vibrations of said vibrator are applied to a wide area of said cushion, the two vibrators being connected by an L-shaped connection plate comprising a horizontal leg in said first cushion and an upright leg disposed in said second cushion, whereby when a user puts one's weight on the armrests, the vibration transmitting assembly in said chair back is projected forwardly to transmit vibration to the user's back.

* * * * *